US010801814B2

(12) United States Patent
Ma et al.

(10) Patent No.: US 10,801,814 B2
(45) Date of Patent: Oct. 13, 2020

(54) GUN MOUNTED LIGHT CAPABLE OF POSITION ADJUSTMENT

(71) Applicant: Shenzhen Olight E-Commerce Technology Co., Ltd., Guangdong (CN)

(72) Inventors: Qiang Ma, Shanxi (CN); Yi Chen, Hubei (CN)

( * ) Notice: Subject to any disclaimer, the term of this patent is extended or adjusted under 35 U.S.C. 154(b) by 0 days.

(21) Appl. No.: 16/364,135

(22) Filed: Mar. 25, 2019

(65) Prior Publication Data

US 2019/0219365 A1 Jul. 18, 2019

(30) Foreign Application Priority Data

Jan. 14, 2019 (CN) ..... 2019 2 0053990 U

(51) Int. Cl.
*F41G 11/00* (2006.01)
*F41G 1/35* (2006.01)

(52) U.S. Cl.
CPC ..... *F41G 11/003* (2013.01); *F41G 1/35* (2013.01)

(58) Field of Classification Search
CPC ..... F41C 27/00; F41G 1/35; F41G 11/003; F41G 11/004
See application file for complete search history.

(56) References Cited

U.S. PATENT DOCUMENTS 6,442,883 B1 * 9/2002 Waterman ..... F41G 11/003 42/124
6,931,778 B1 * 8/2005 Nelson ..... F41G 1/35 42/120
7,107,716 B1 * 9/2006 Liao ..... F41C 27/00 42/108
7,219,370 B1 * 5/2007 Teetzel ..... A42B 3/04 2/422
9,677,854 B1 * 6/2017 Tran ..... F41G 11/003
9,841,258 B1 * 12/2017 Galli ..... F41G 11/003
10,107,592 B1 * 10/2018 Huang ..... F41G 1/35
10,365,069 B1 * 7/2019 Tayon ..... F41G 11/003
2010/0229450 A1 * 9/2010 Becker ..... F41C 23/14 42/90
2011/0167703 A1 * 7/2011 Deros ..... F41G 11/003 42/90

(Continued)

FOREIGN PATENT DOCUMENTS

GB 2504466 A * 2/2014 ..... F41G 11/003

*Primary Examiner* — Gabriel J. Klein
(74) *Attorney, Agent, or Firm* — Prakash Nama; Global IP Services, PLLC

(57) ABSTRACT

A gun mounted light, having a light, a rail disposed at one side of the light, and a clamping assembly movably connected to the rail. The clamping assembly has a mounting seat movably connected to the rail, and a movable clamp connected at one side of the mounting seat. A fixed clamp cooperating with the movable clamp is provided on the mounting seat. A side of the mounting seat distal from the movable clamp is connected with a handle. The movable clamp is connected with one end of a pull rod; the pull rod is rotatably connected with a cam on the handle. A first resilient piece is provided between the cam and the mounting seat. A side of the mounting seat proximal to the light is provided with a sliding groove cooperative with the rail. A locking component is provided between the first resilient piece and the mounting seat.

5 Claims, 9 Drawing Sheets

(56) References Cited

U.S. PATENT DOCUMENTS

| | | | | |
|---|---|---|---|---|
| 2012/0198745 | A1* | 8/2012 | Riley | F41C 27/00<br>42/90 |
| 2015/0316355 | A1* | 11/2015 | Boswell | F41G 11/004<br>42/146 |
| 2019/0145731 | A1* | 5/2019 | Stewart | F41G 11/003<br>42/90 |
| 2019/0242677 | A1* | 8/2019 | Ding | F41G 11/003 |

* cited by examiner

GUN MOUNTED LIGHT CAPABLE OF POSITION ADJUSTMENT

TITLE OF THE INVENTION

A gun mounted light capable of position adjustment

BACKGROUND OF THE INVENTION

The present invention belongs to the technical field of gun mounted light, and more specifically relates to a gun mounted light capable of position adjustment.

In the prior art, a gun mounted light is generally fixed to a gun by fixed connection to a mounting rail on the gun via a clamping mechanism. The clamping mechanism is formed integrally with the gun mounted light, such that their relative positions are unchangeable. When a gun mounted light is fixed on a gun having a Picatinny rail, a position of the gun mounted light on the gun cannot be flexibly adjusted frontward or rearward. When there are different types and shapes of guns, an ordinary gun mounted light does not have high compatibility and adaptability to all those different guns, or it is impossible to adjust the gun mounted light to an optimal position that suits most to the user. Some quick clamping mechanisms for gun mounted lights now available in the market let the gun mounted lights to fall off once the handles are triggered, thereby exposing the gun mounted light to the risk of falling during disassembly.

BRIEF SUMMARY OF THE INVENTION

In view of the aforesaid disadvantages now present in the prior art, the present invention provides a gun mounted light capable of position adjustment between the light and the clamping assembly so that the gun mounted light has higher compatibility and adaptability. Also, the present invention prevents the problem of sudden falling and the resulting damage of the gun mounted light when the clamping assembly is unlocked.

To fulfil the above objects, the present invention provides the following technical solutions:

A gun mounted light capable of position adjustment, comprising a light, a rail disposed at one side of the light, and a clamping assembly movably connected to the rail.

Further, the clamping assembly comprises a mounting seat movably connected to the rail, and a movable clamp connected at one side of the mounting seat; a fixed clamp cooperating with the movable clamp to provide clamping force is provided on the mounting seat.

Further, a side of the mounting seat distal from the movable clamp is connected with a handle; the handle controls movements of the movable clamp to determine an amount of clamp force being applied; the movable clamp is connected with one end of the pull rod; the pull rod is rotatably connected with a cam disposed on the handle.

Further, a first resilient piece is provided between the cam and the mounting seat; the first resilient piece sleeves around the pull rod.

Further, a side of the mounting seat proximal to the light is provided with a sliding groove cooperative with the rail.

Further, a locking component is provided between the first resilient piece and the mounting seat; the locking component locks against the rail.

Further, a side of the locking component proximal to the rail is provided with a first toothed panel; the rail is provided with a second toothed panel cooperative with the first toothed panel.

Further, a gasket is provided between the locking component and the cam.

Further, a second resilient piece is also provided between the pull rod and the movable clamp.

Further, a side of the movable clamp proximal to the mounting seat is provided with a guiding rod.

Beneficial effects of the present invention:

A rail is provided on the light to adjust a position of the light relative to the clamping assembly, such that the gun mounted light has higher compatibility and adaptability. Also, resilient pieces are provided in the clamping assembly to provide pre-clamping force to effectively prevent sudden falling of the gun mounted light when the clamping assembly is unlocked, and thus prevent the subsequent damage of the gun mounted light as a result of the sudden fall.

1—handle; 101—cam; 2—gasket; 3—pull rod; 4—first resilient piece; 5—locking component; 501—first toothed panel; 6—mounting seat; 601—fixed clamp; 602—sliding groove; 7—movable clamp; 701—guiding rod; 702—accomodation trough; 8—second resilient piece; 9—nut; 10—light; 11—rail; 1101—second toothed panel; 12—shaft pin.

DETAILED DESCRIPTION OF THE INVENTION

Some embodiments of the present invention are further described in detail below. The embodiments are illustrated in the figures. Identical or like references throughout the description and the figures represent identical or like components or components having the same or similar functions. The embodiments described below with reference to the figures should be considered illustrative for the purpose of explaining the technical features of the present invention, and should not be considered as any limitation to the present invention.

In the present invention, it should be noted that directions or positional relationships indicated by terms such as "length", "width", "upper", "lower", "front", "rear", "left", "right", "vertical", "horizontal", "top", "bottom" should be understood based on the directions or positional relationships according to the figures, and should also be understood as merely means for simplification for the sake of easier illustration of the present invention. It is not meant or intended to mean that the devices or components concerned should have such specifically described directions, or should be configured or operated according to the specifically described directions, and hence should not be considered as any limitation to the present invention.

Further, terms like "first", "second" are used for illustrative purpose, and should not be understood as meaning or implying relative importance or as a subtle indication of a quantity of the described technical feature. Therefore, a feature defined by "first" or "second" may comprises by obvious indication or subtle implication, one or more than one of said feature in terms of quantity. In the description, "a plurality of" means a quantity of two or above, unless otherwise specified.

In the present invention, unless otherwise specified, terms such as "install", "connect", "communicate" and "fix" should be understood broadly. For example, a fixed connection, a removable connection, or integral formation may be intended. Further, connection may be mechanical or electrical, direct or indirect through a medium, and may be an internal communication between two components or an interactive relationship between two components. A person skilled in this field of art should be able to understand the specific meaning of the terms described in the present invention according to the context of the practical situation described.

Figure 1:
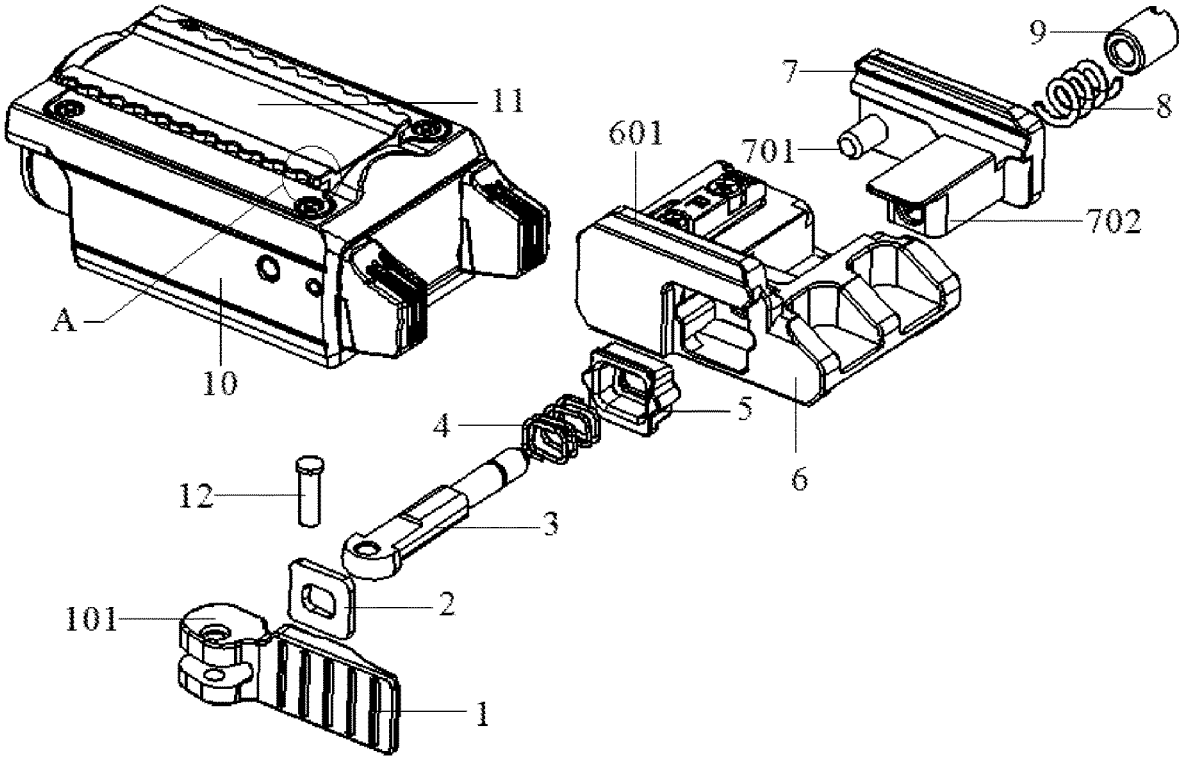
FIG. 1 is an exploded schematic structural view of the gun mounted light of the present invention.
Figure 2:
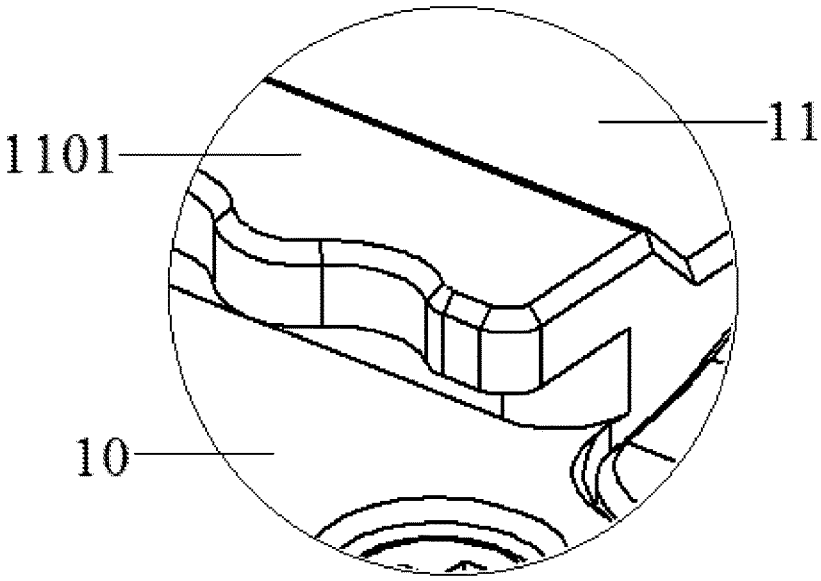
FIG. 2 is an enlarged view of portion A of FIG. 1.
Figure 3:
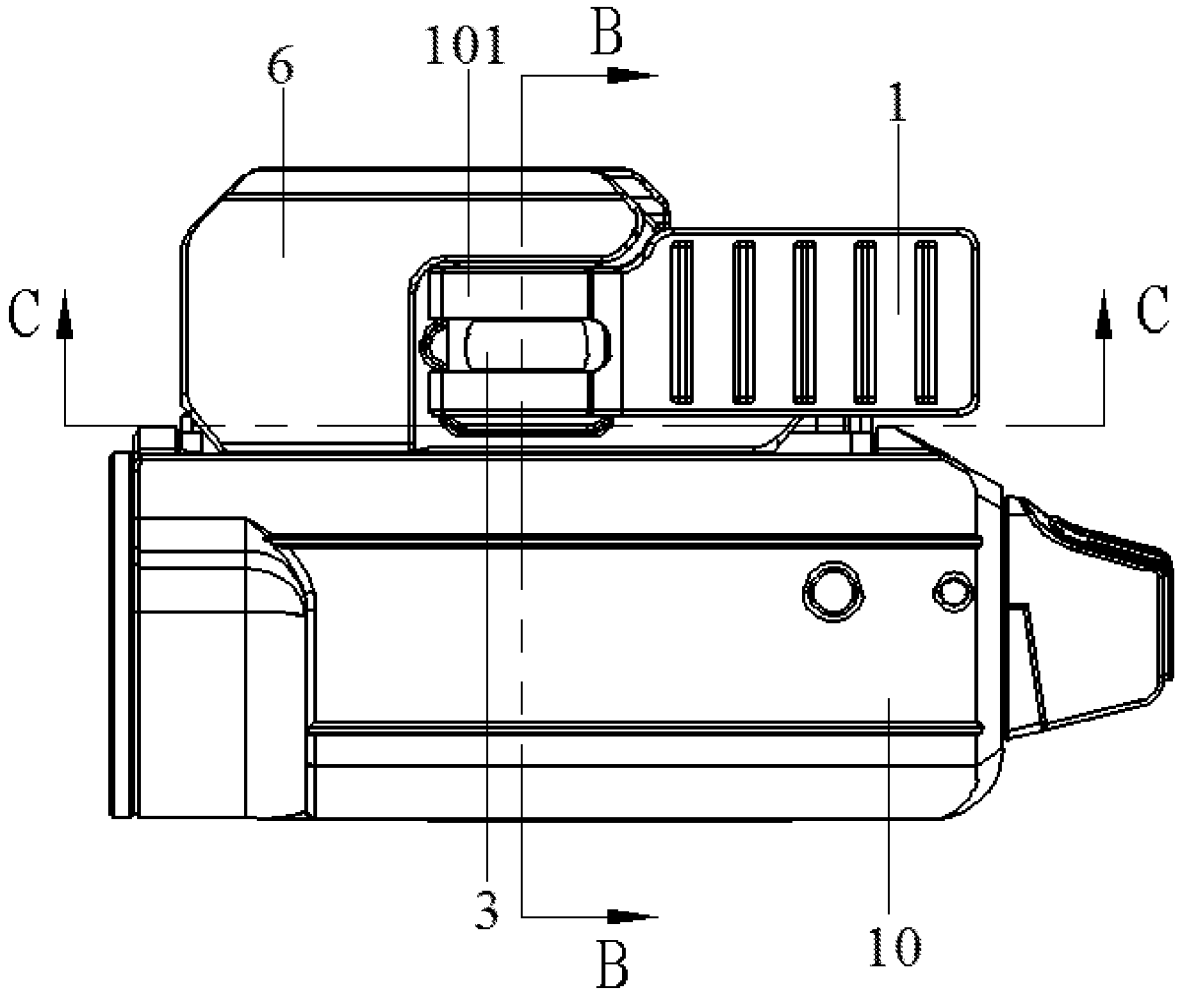
FIG. 3 is a side structural view of the gun mounted light of the present invention.
Figure 4:
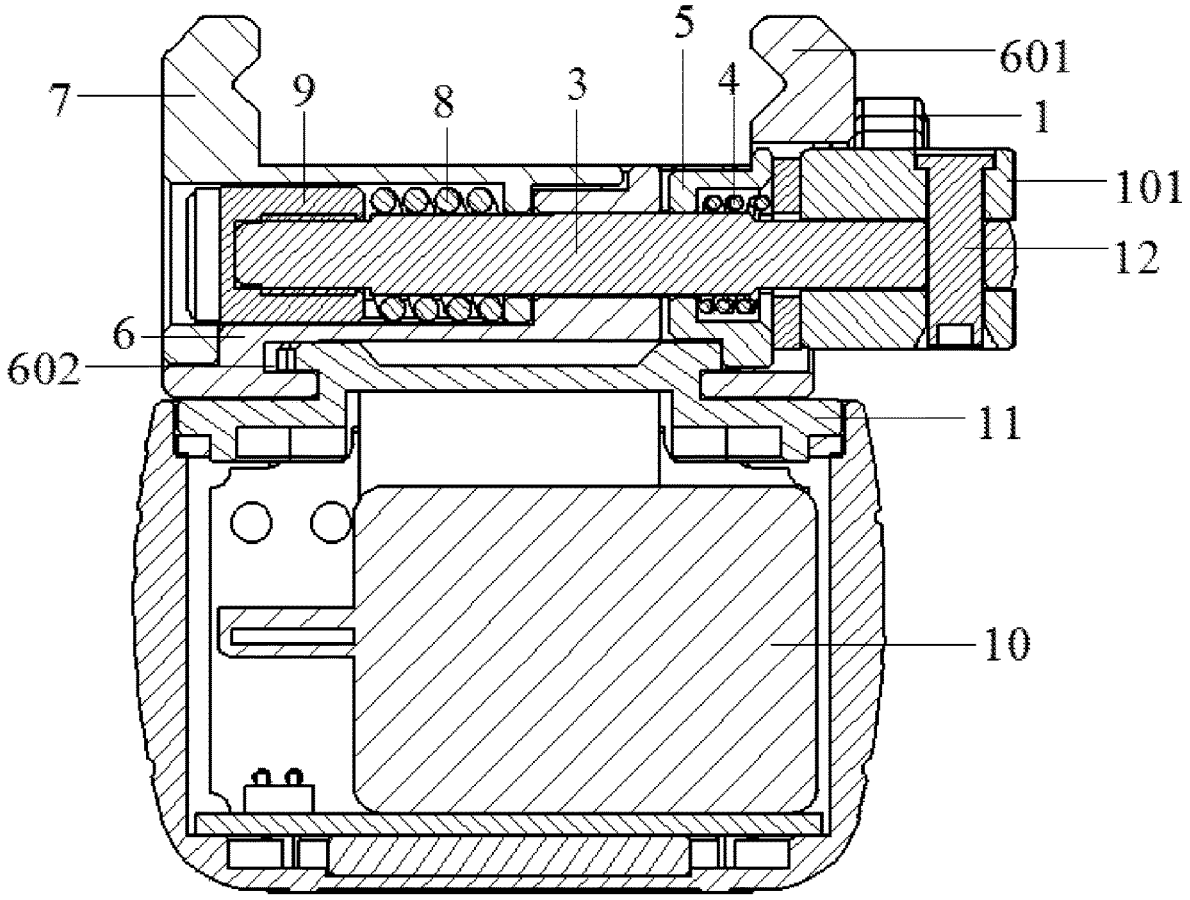
FIG. 4 is a sectional view showing the structure of the gun mounted light along line B-B of FIG. 3.
Figure 5:
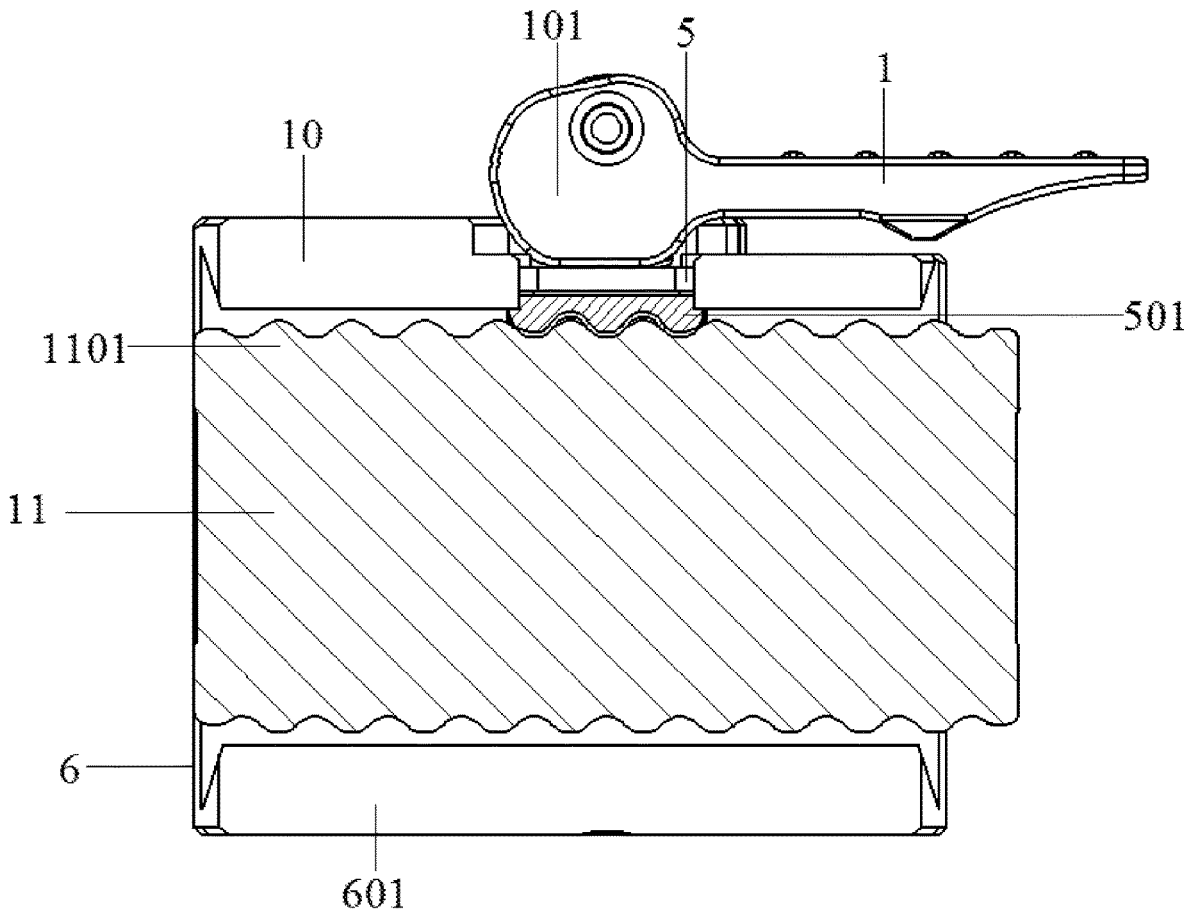
FIG. 5 a sectional view showing the structure of the gun mounted light along line C-C of FIG. 3.

As shown in FIGS. 1, 3 and 4, a gun mounted light capable of position adjustment is provided according an embodiment, comprising a light 10, a rail 11 disposed at one side of the light 10, and a clamping assembly movably connected to the rail 11. During use, the clamping assembly clamps a gun; a position of the light 10 relative to the gun can be adjusted by adjusting a position of the rail 11 relative to the clamping assembly.

With reference to FIGS. 1, 3, and 4, in some embodiments of the present invention, the clamping assembly comprises a mounting seat 6 movably connected to the rail 11, and a movable clamp 7 connected at one side of the mounting seat 6; a fixed clamp 601 cooperating with the movable clamp 7 to provide clamping force is provided on the mounting seat 6. According to an embodiment, a first recessed surface is provided on a side of the fixed clamp 601 facing towards the movable clamp 7, and a second recessed surface is provided on a side of the movable clamp 7 facing towards the fixed clamp 601, so as to facilitate the fixed clamp 601 and the movable clamp 7 to clamp the gun. According to an embodiment, the movable clamp 7 is connected to the mounting seat 6 via a pull rod 3; one end of the pull rod 3 passes through the movable clamp 7 and then fixedly connects with a nut 9, so that the end of the pull rod 3 connected with the nut is limited to a position at a side of the movable clamp 7 distal from the mounting seat 6; an opposite end of the pull rod 3 distal from the movable clamp 7 passes through the mounting seat 6 and then rotatably connects to a handle 1 via a shaft pin 12 so as to achieve rotation of the handle 1 relative to the pull rod 3; a cam 101 is provided at a point of connection between the handle 1 and the pull rod 3 so as to lock the handle 1.

In some embodiments, a first resilient piece 4 is provide between the cam 101 and the mounting seat 6; the first resilient piece 4 is a spring; the first resilient piece 4 sleeves around the pull rod 3 to prevent biasing of the first resilient piece 4 and to provide stable resilient force; one end of the first resilient piece 4 abuts against the cam 101; an opposite end of the first resilient piece 4 distal from the cam 101 abuts a blocking piece of the mounting seat 6, such that when the handle 1 is locked, the first resilient piece 4 provides resilient force to drive the cam 101 to move towards a side away from the mounting seat 6, which in turns drive the opposite end of the pull rod 3 distal from the movable clamp 7 and proximal to the cam 101 to move towards a direction away from the mounting seat 6, as a result, the movable clamp 7 is driven to move towards the mounting seat 6 and thus achieving clamping action between the movable clamp 7 and the fixed clamp 601.

In other embodiments, the first resilient piece 4 can be resilient strips symmetrically arranged at two sides of the pull rod 3 respectively to provide resilient force.

In some embodiments, a gasket 2 made of soft material is provided between the first resilient piece 4 and the cam 101 to prevent abrasion of the cam 101 during rotation. In some embodiments, a second resilient piece 8 is also provided between the nut 9 and the movable clamp 7; the movable clamp 7 is provided with an accommodation trough 702 to accommodate the second resilient piece 8 and the nut 9; one end of the second resilient piece 8 abuts against the nut 9; an opposite end of the second resilient piece 8 distal from the nut 9 abuts against an end surface of the accommodation trough 702 to provide buffering. In the embodiments illustrated in the figures, the second resilient piece 8 is a spring, and the second resilient piece 8 also sleeves around the pull rod 3.

In some other embodiments, the second resilient piece 8 is a resilient strip.

With reference to FIGS. 1-5, in some embodiments, a side of the mounting seat 6 proximal to the light 10 is provided with a sliding groove 602 cooperative with the rail 11; the rail 11 is inserted into the sliding groove 602 and is slidable therein to adjust a position of the light 10 relative to the clamping assembly. According to some embodiments, a locking component 5 is provided between the first resilient piece 4 and the mounting seat 6; a side of the locking component 5 proximal to the rail 11 is provided with a first toothed panel 501; the rail 11 is provided with a second toothed panel 1101 engagable with the first toothed panel 501; the mounting seat 6 is capable of moving progressively relative to the rail 11 by a tooth-length of the first toothed panel each time; during use, when the handle 1 is locked, the locking component 5 and the rail 11 are also locked with respect to each other, so as to fix the light 10 relative to the clamping assembly.

Figure 9:
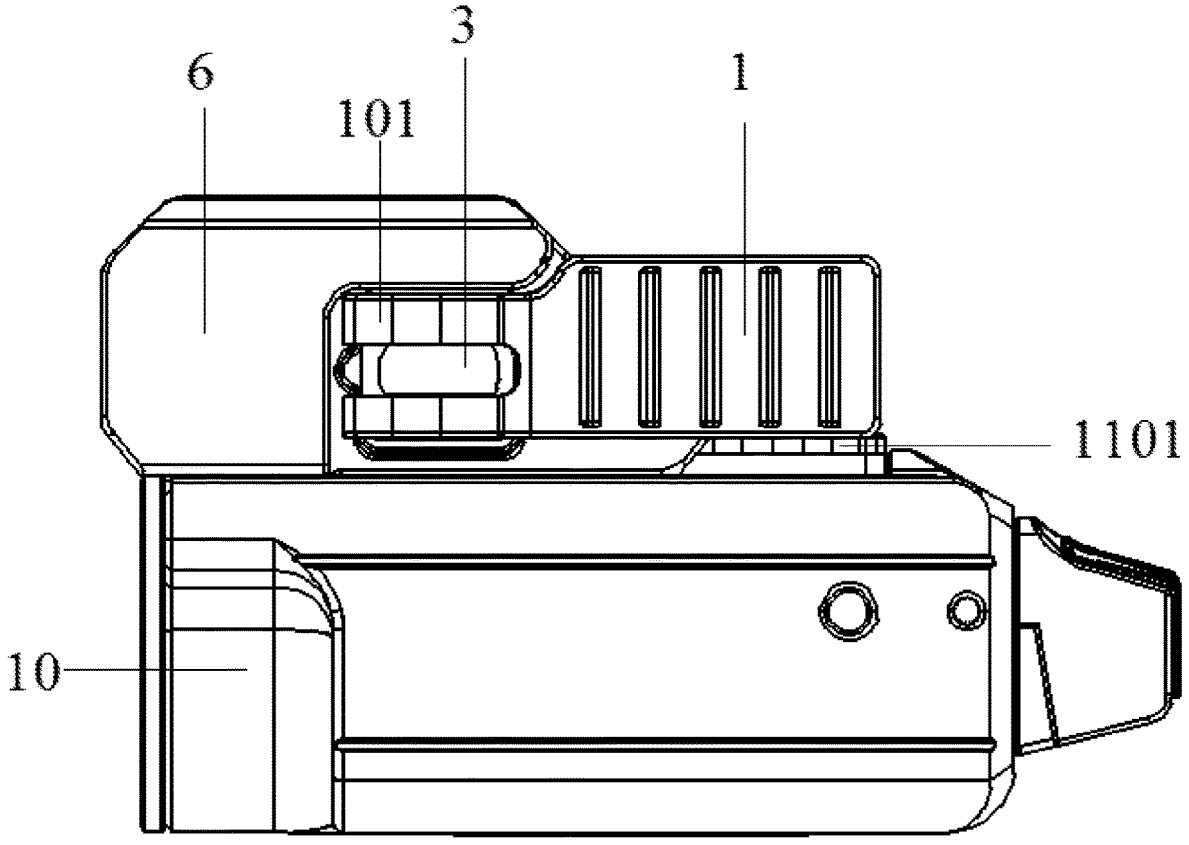
FIG. 9 is a structural view showing the gun mounted light in one of the use positions.
Figure 10:
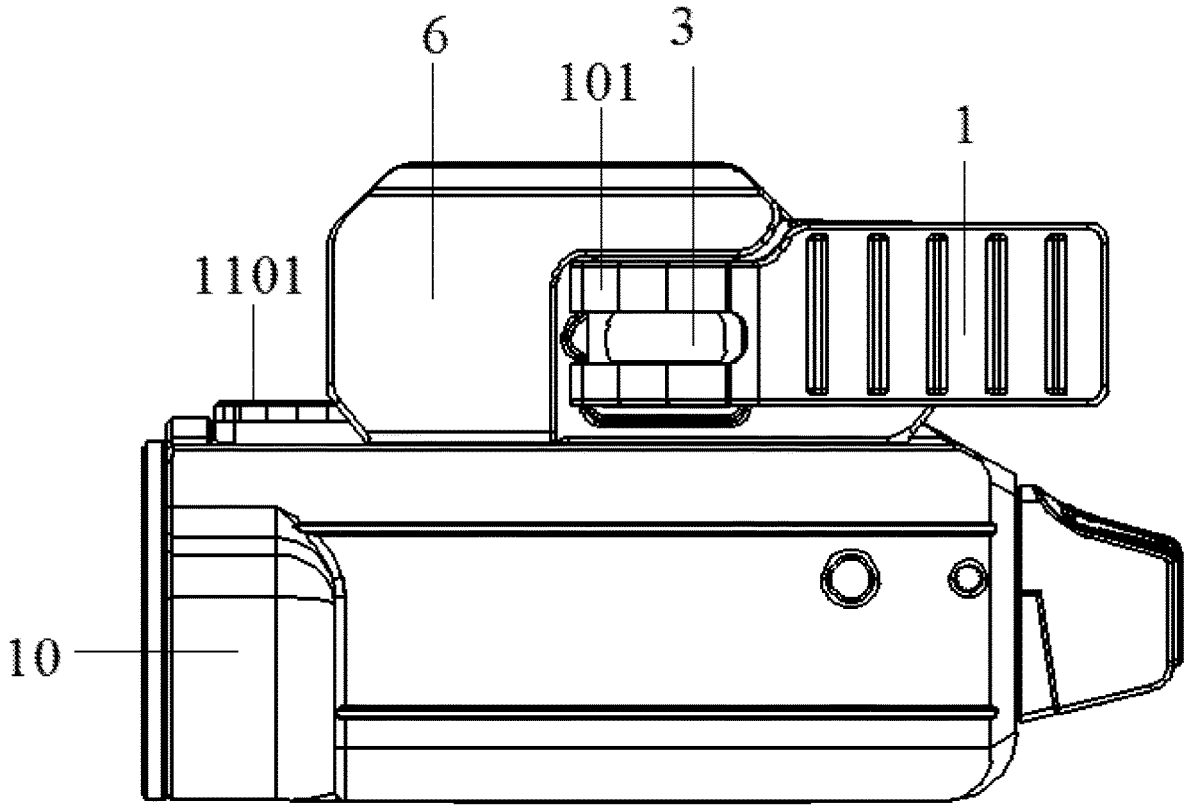
FIG. 10 is a structural view showing the gun mounted light in another one of the use positions after position adjustment.

With reference to FIGS. 9-10, when it is required to adjust a position of the light 10 relative to the clamping assembly, rotate to unlock the handle 1 so that the handle 1 is in a movable condition, and then pull the light 10 so that the light 10 moves relative to the clamping assembly; after the light 10 is adjusted to a desirable position, lock the handle 1 again.

In some embodiments, a side of the movable clamp 7 proximal to the mounting seat 6 is provided with a guiding rod 701; a side of the mounting seat 6 proximal to the movable clamp 7 is provided with a hole cooperative with the guiding rod 701.

Figure 6:
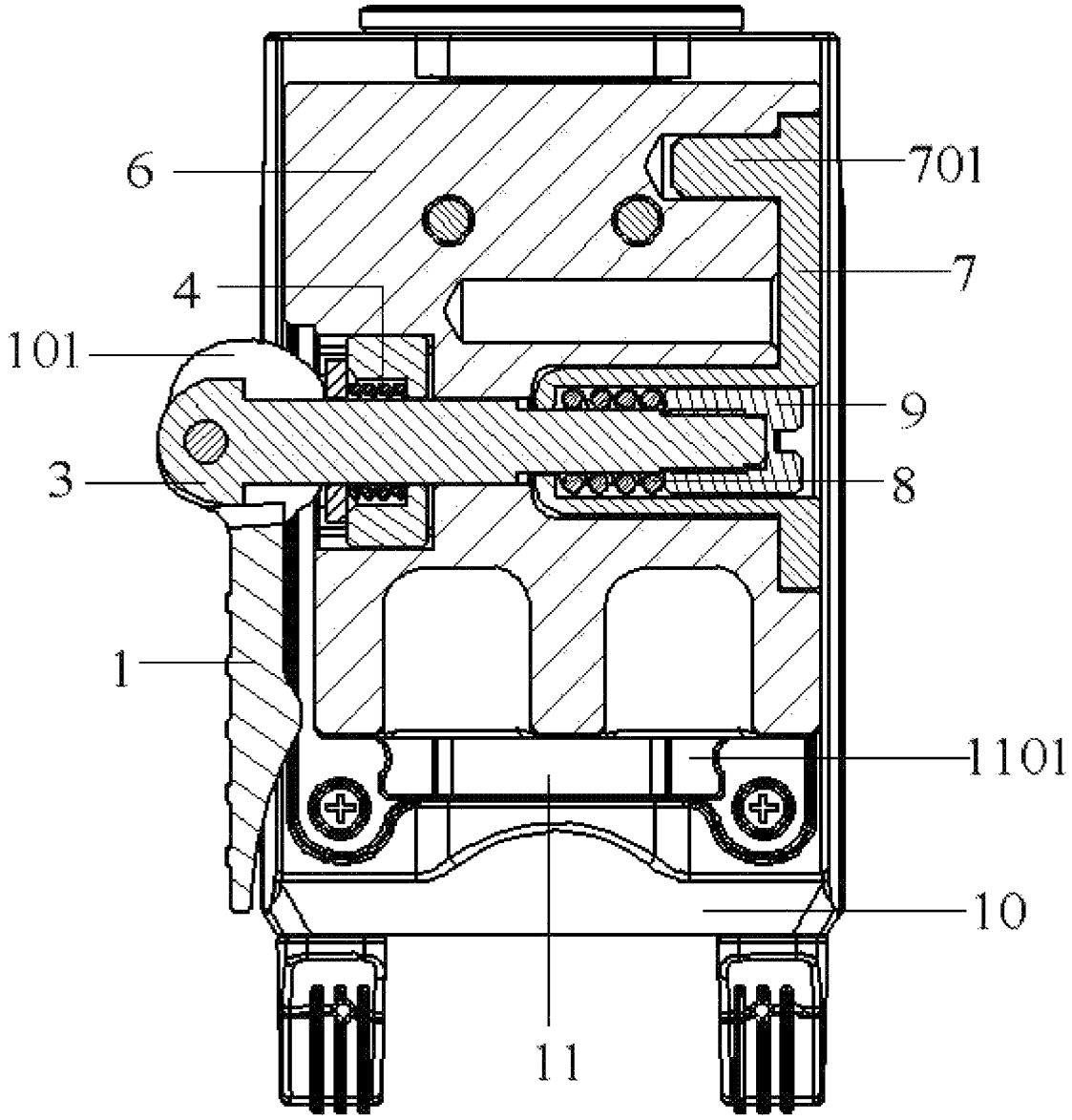
FIG. 6 is a sectional structural view of the gun mounted light in a locked condition.
Figure 7:
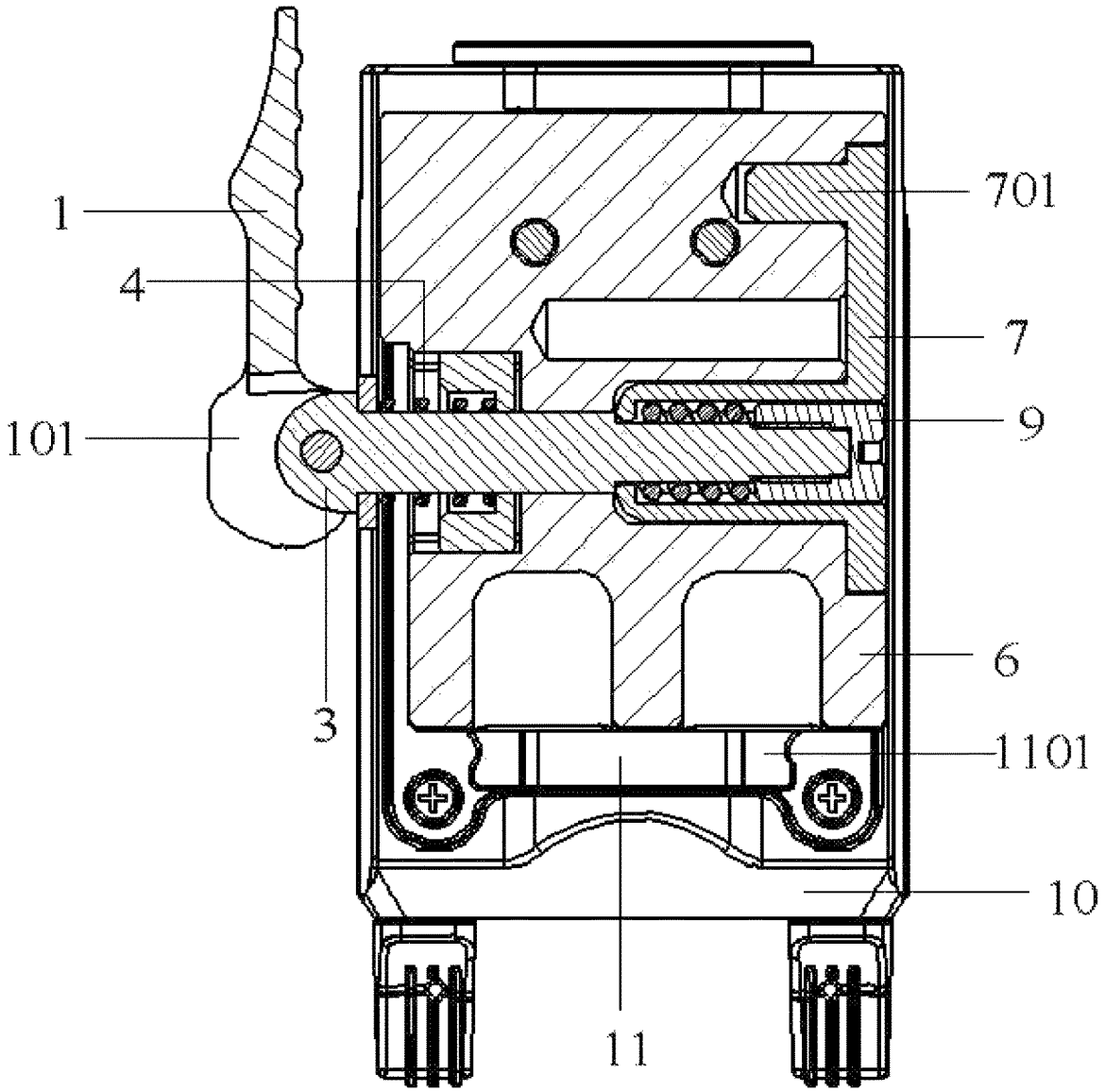
FIG. 7 is a sectional structural view of the gun mounted light when the handle is unlocked.
Figure 8:
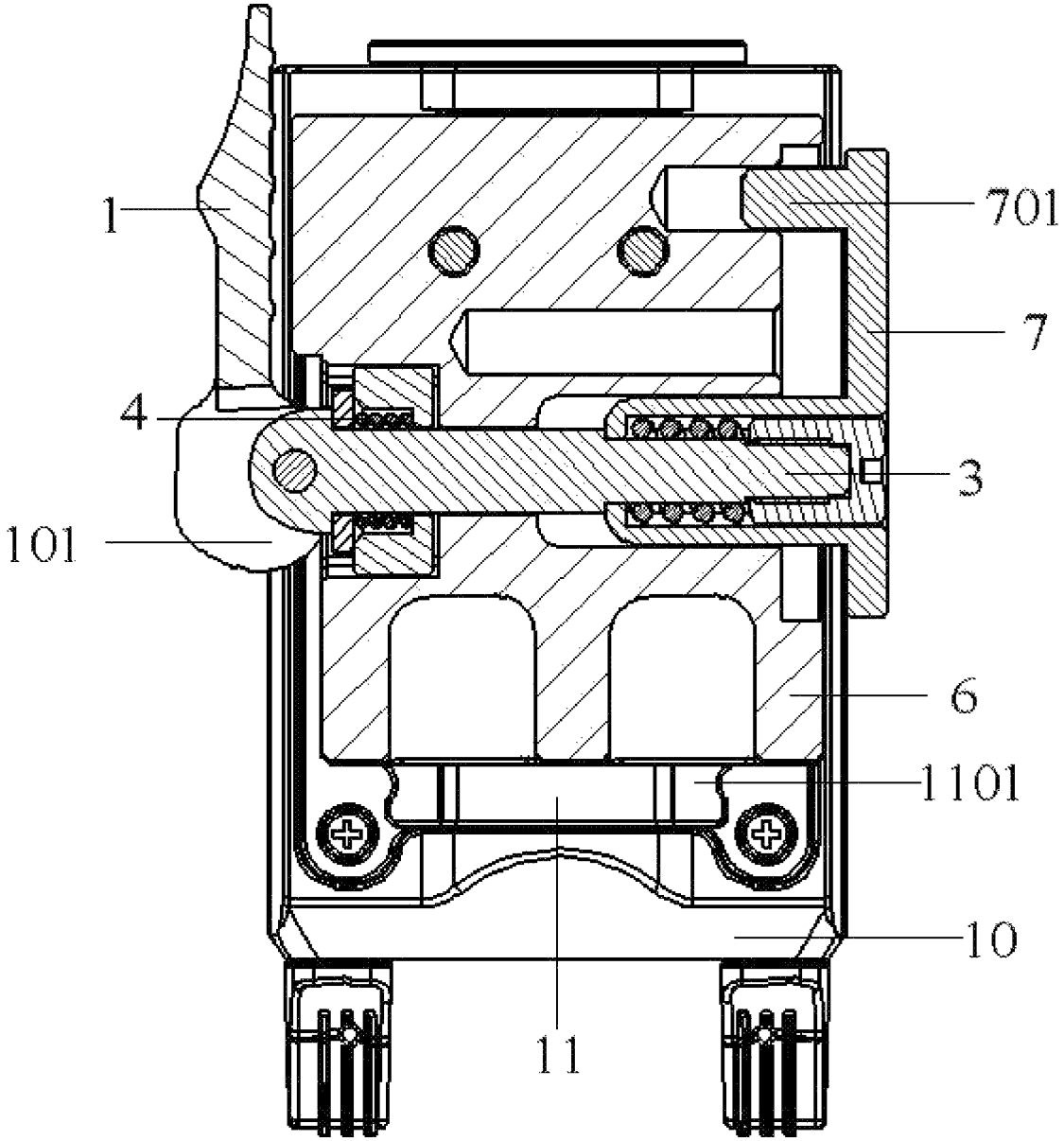
FIG. 8 is a sectional structural view of the gun mounted light during position adjustment.

FIGS. 6-8 are internal structural views of the gun mounted light capable of position adjustment according to the present invention during use. When the handle 1 is locked, under the resilient force of the first resilient piece 4, the pull rod 3 pulls the movable clamp 7 towards the fixed clamp 601 so as to provide clamping force between the movable clamp 7 and the fixed clamp 601; due to the cam design at the point of connection between the handle 1 and the mounting seat 6, the handle 1 can be prevented from arbitrary movements, and hence the clamping force provided between the movable clamp 7 and the fixed clamp 601 is stable. When it is required to dismount the gun mounted light from the gun, rotate the handle 1 to another side to unlock the handle 1 so as to overcome the resilience of the first resilient piece 4 and the action force of the cam 101; when the handle 1 is unlocked and in a movable condition, resilient force of the first resilient piece 4 will still drive the pull rod 3 to pull the movable clamp 7 towards the fixed clamp 601 and thus providing pre-clamping force; as such, the gun mounted light is still fixed on the gun, thereby preventing sudden falling of the gun mounted light from the gun and also its subsequent damage after the handle 1 is unlocked. By operating the cam 101 to overcome the resilient force of the first resilient piece 4, and then pushing the movable clamp 7 away from the fixed clamp 610, the gun mounted light can be dismounted from the gun. When handle 1 is unlocked and in a movable condition, the locking component is loosened from the rail 11 such that the light 10 can be moved to adjust a horizontal position of the light 10 relative to the gun. After adjustment, lock the handle 1 again to fix the light 10 with respect to the gun.

The description above illustrates only the more preferred embodiments of the present invention. Ordinary changes and replacements made within the scope of teachings of the present invention by a person skilled in the art should also fall within the scope of the present invention.

What is claimed is:

1. A gun mounted light capable of position adjustment, comprising a light, a rail disposed at one side of the light, and a clamping assembly movably connected to the rail; the clamping assembly comprises a mounting seat movably connected to the rail, and a movable clamp connected at one side of the mounting seat; a fixed clamp cooperating with the movable clamp to provide clamping force is provided on the mounting seat; a side of the mounting seat distal from the movable clamp is connected with a handle; the handle controls movements of the movable clamp to determine an amount of clamp force being applied; the movable clamp is connected with one end of a pull rod through a nut; the pull rod is rotatably connected with a cam disposed on the handle; a first resilient piece is provided between the cam and the mounting seat; the first resilient piece sleeves around the pull rod; a second resilient piece is provided between the nut and the movable clamp; the first and second resilient pieces are provided in the clamping assembly to provide pre-clamping force to prevent sudden falling of the gun mounted light when the clamping assembly is unlocked; a locking component is provided between the first resilient piece and the mounting seat; the locking component locks against the rail.

2. The gun mounted light of claim 1, wherein a side of the mounting seat proximal to the light is provided with a sliding groove cooperative with the rail.

3. The gun mounted light of claim 1, wherein a side of the locking component proximal to the rail is provided with a first toothed panel; the rail is provided with a second toothed panel cooperative with the first toothed panel.

4. The gun mounted light of claim 1, wherein a gasket is provided between the locking component and the cam.

5. The gun mounted light of claim 1, wherein a side of the movable clamp proximal to the mounting seat is provided with a guiding rod.

* * * * *